US007231924B2

(12) United States Patent
Shaw et al.

(10) Patent No.: US 7,231,924 B2
(45) Date of Patent: Jun. 19, 2007

(54) DEODORIZER FOR CIGARETTE BUTT COLLECTION CONTAINERS

(75) Inventors: Mark D. Shaw, Ponte Vedra Beach, FL (US); J. Tad Heyman, Atlantic Beach, FL (US); Laurence M. Bierce, Macclenny, FL (US)

(73) Assignee: UltraTech International, Inc., Jacksonville, FL (US)

( * ) Notice: Subject to any disclaimer, the term of this patent is extended or adjusted under 35 U.S.C. 154(b) by 386 days.

(21) Appl. No.: 10/424,052

(22) Filed: Apr. 25, 2003

(65) Prior Publication Data

US 2003/0200974 A1 Oct. 30, 2003

Related U.S. Application Data

(60) Provisional application No. 60/375,485, filed on Apr. 25, 2002.

(51) Int. Cl.
*A24D 1/12* (2006.01)

(52) U.S. Cl. ..... 131/231; 131/359; 206/246; 220/560.01

(58) Field of Classification Search ..... 131/231, 131/235.1; 220/576, 676; 206/246; 96/108
See application file for complete search history.

(56) References Cited

U.S. PATENT DOCUMENTS

| | | | | | |
|---|---|---|---|---|---|
| 1,724,579 | A | * | 8/1929 | Gunnell | 220/495.11 |
| 2,119,267 | A | * | 5/1938 | Coleman | 362/155 |
| 2,718,432 | A | * | 9/1955 | Hudachek | 239/57 |
| 3,860,404 | A | * | 1/1975 | Jochimski | 96/147 |
| 3,921,646 | A | | 11/1975 | Kosta | |
| 4,052,179 | A | * | 10/1977 | Kirk | 96/139 |
| 4,780,370 | A | * | 10/1988 | Pointier | 428/404 |
| 5,022,553 | A | * | 6/1991 | Pontius | 206/205 |
| 5,676,316 | A | | 10/1997 | Hanna | |
| 5,906,314 | A | | 5/1999 | Kinay | |
| 6,161,549 | A | | 12/2000 | Lee | |
| 6,170,490 | B1 | | 1/2001 | Barrow | |
| 6,186,355 | B1 | * | 2/2001 | Luedecke | 220/576 |

* cited by examiner

*Primary Examiner*—Steven P. Griffin
*Assistant Examiner*—John B. Edel
(74) *Attorney, Agent, or Firm*—Thomas C. Saitta

(57) ABSTRACT

A deodorizing apparatus for suppressing odor emanating from a cigarette butt containment vessel. The cigarette butt containment vessel includes a partially enclosed basin cavity into which cigarette butts are collected. In accordance with the present invention, the deodorizing apparatus includes an odor absorption device mounted within the basin cavity of the cigarette butt containment vessel. The odor absorption device includes an absorptive material housing constructed of an air-permeable fabric or mesh that retains the odor absorptive material while permitting airflow between the basin cavity and the interior of the absorptive material housing.

39 Claims, 5 Drawing Sheets

DEODORIZER FOR CIGARETTE BUTT COLLECTION CONTAINERS

CROSS REFERENCE TO RELATED APPLICATIONS

This application claims the benefit of U.S. provisional patent application Ser. No. 60/375,485 filed on Apr. 25, 2002, the contents of which are incorporated herein by reference.

BACKGROUND OF THE INVENTION

1. Technical Field

The present invention relates generally to the field of filtering or deodorizing devices, and more particularly to the field of such devices that deodorize, filter or capture odors and smoke from containers or receptacles for cigarette ashes and cigarette butts. Still more particularly, the invention relates to such devices that deodorize, filter or capture odors and smoke from cigarette butts deposited into containers or receptacles for disposal.

2. Description of the Related Art

Due to the acknowledged dangers of cigarette smoke and in particular second hand smoke, many buildings are now designated as non-smoking buildings where smokers are not allowed to have or bring lit cigarettes inside. Often a designated outdoor smoking area is provided where employees or others may congregate to partake of a smoking break during the day. Because of these policies, it is not uncommon to find a cigarette butt disposal problem at building entrances and designated smoking areas, in that many individuals will simply drop their cigarette butts or partially smoked cigarettes on the ground, resulting in unsightly collections of large numbers of cigarette butts. Since the butts do not degrade, the areas must be cleaned often.

A common response to this situation has been to place ashtray-type trash collector devices in the needed locations. These ashtray-type devices consist of an upright cylindrical tube with a concave retainer of exposed sand on the top. Apertures for insertion of trash are placed on the side of the cylinder. These devices are not suitable for external locations where wind and rain may be encountered, and the devices are not aesthetically pleasing since the cigarette butts are simply stuck into the sand where they remain visible until the sand is cleaned.

More recently, cigarette butt containment vessels have been developed that are designed to receive the cigarette butts internally while presenting a more pleasant appearance. An example of such a device is shown in U.S. Pat. No. 6,186,355, issued Feb. 13, 2001, to Luedcke, the disclosure of which is incorporated herein by reference. The Luedcke containment vessel has a housing with a receptacle base that retains a removable bucket-type container. The upper portion of the housing is a removable elongated tube that is much narrower than the receptacle base. Lateral openings are disposed near the top of the tube to receive the cigarette butts being disposed. The tube is centered over the receptacle base and bucket, such that the butts are guided into the bucket when inserted through the lateral openings. The housing is typically made of plastic, while the bucket is metal so as to be maximally resistant to heat damage.

While this design addresses the visual problem associated with cigarette butt disposal, a new problem related to odor arises with their use. The disposal of large numbers of cigarette butts results in an accumulation of smoke, nicotine and tar within the containment vessel, regardless of how often the vessel is emptied, which over time is of sufficient concentration such that a strong, foul odor is emitted through the lateral openings that is readily apparent to anyone passing by or using the containment vessel.

It can therefore be appreciated that a need exists for a solution to the problem of odorous cigarette butt containers. The present invention addresses such a need.

SUMMARY OF THE INVENTION

A deodorizing apparatus for suppressing odor emanating from a cigarette butt containment vessel is disclosed herein. The cigarette butt containment vessel includes a partially enclosed basin cavity into which cigarette butts are collected. In accordance with the present invention, the deodorizing apparatus includes an odor absorption device mounted within the basin cavity of the cigarette butt containment vessel. The odor absorption device includes an absorptive material housing constructed of an air-permeable fabric or mesh that retains the odor absorptive material while permitting airflow between the basin cavity and the interior of the absorptive material housing.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF A PREFERRED EMBODIMENT

This invention is described in a preferred embodiment in the following description with reference to the figures. While this invention is described in terms of the best mode for achieving this invention's objectives, it will be appreciated by those skilled in the art that variations may be accomplished in view of these teachings without deviating from the spirit or scope of the present invention.

The present invention is directed to providing a solution to the odor problem inherent in cigarette butt containment devices, by providing an odor absorption device disposed within the containment device to absorb the smoke and odors such that they do not escape the containment device, and furthermore to provide such a device that suppresses smoldering or flames and is disposable.

As explained in further detail with reference to the figures, the odor absorption device of the present invention is disposed internally to cigarette butt containment vessels of the type having a vertical tubular throat centered over a wider receptacle base containing a non-flammable bucket or bucket-like receptacle. The odor absorption device comprises an odor absorptive material, typically a particulate material such as sodium carbonate, sodium bi-carbonate, activated carbon or the like, retained within a non-flammable, gas-permeable cover or housing material. The smoke and odors released by the cigarette butts are absorbed by the absorption device, which is disposed of periodically or whenever the containment device is emptied.

In a most general sense, the invention is an odor and smoke absorption device for use in combination with cigarette butt containment devices, to prevent or reduce emission of smoke and accumulated odors produced by numerous cigarette butts collected within the containment device. In certain embodiments, the absorption device may be mounted onto an interior surface of the butt containment device or may be annular and doughnut-like in shape and mounted at the base of the vertical throat or atop a cigarette butt receptacle bucket, such that the central opening allows the butts to pass into the receptacle bucket. Alternatively, the absorption device may be formed in a bag-like configuration and disposed within the receptacle bucket itself as a non-flammable liner, such that the butts fall directly into the open top of the absorption bag device, allowing the butts to be removed from the containment vessel by simply removing the absorption bag device, which may further be provided with a drawstring or similar closure means. In still another alternative embodiment, the absorption device is configured as a bottomless receptacle liner in which the odor absorptive material is retained in a liner lining the lateral inner wall surfaces of the bucket receptacle such that the cigarette butts collect at the bottom of the receptacle bucket surface and do not permanently damage or discolor the odor absorption device.

Figure 1:
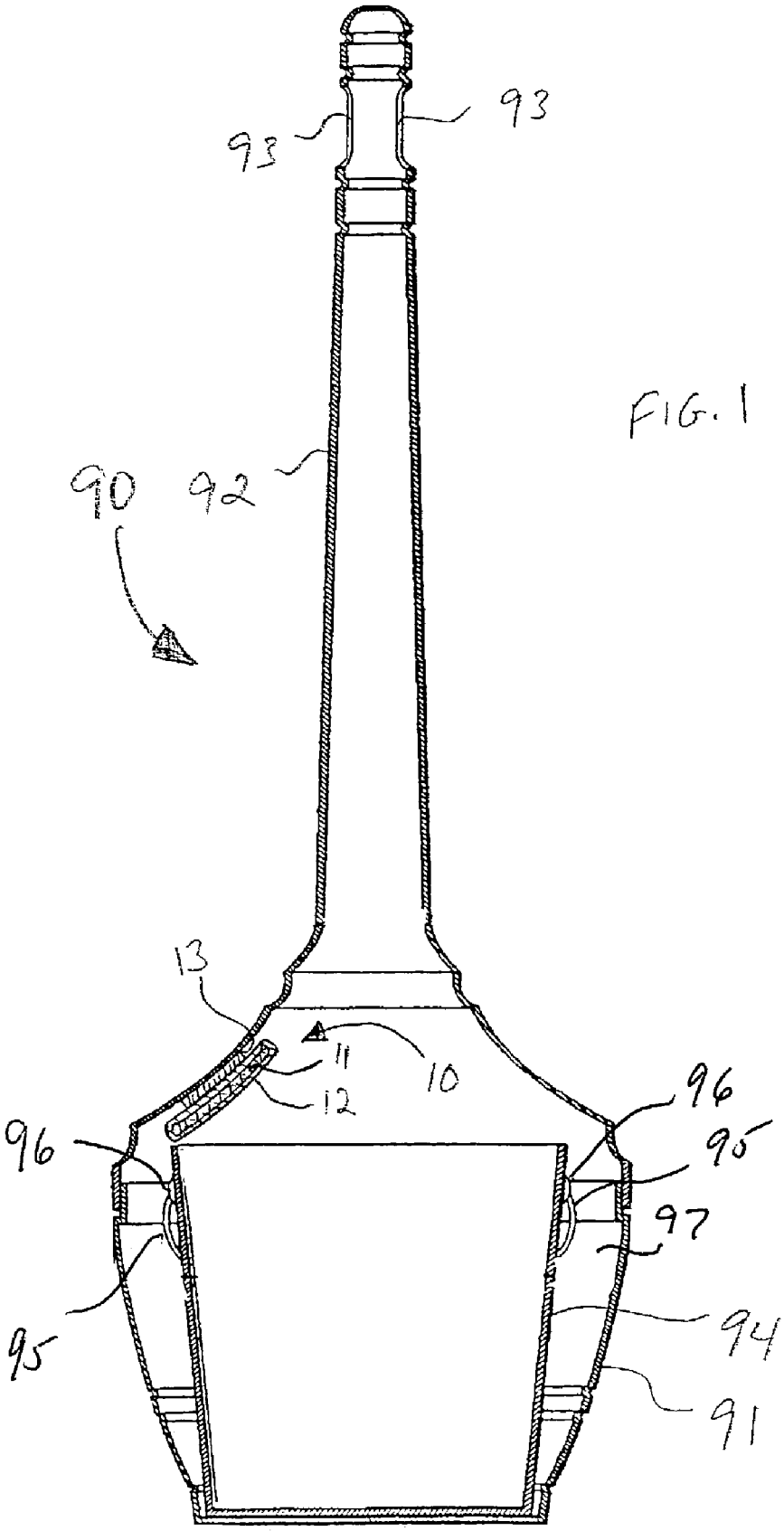
FIG. 1 is a cross-section view of an odor absorption device deployed within a cigarette butt containment vessel in accordance with one embodiment of the present invention.

With reference now to the figures, wherein like reference numerals refer to like and corresponding parts throughout, and in particular with reference to FIG. 1, there is depicted by way of example a cross-section view of a cigarette butt containment vessel 90 having an overall containment structure of the type disclosed in U.S. Pat. No. 6,186,355. Containment vessel 90 is typically formed of plastic, having an open-topped basin member 91 and an elongated, tubular throat member 92, the throat member 92 having the shape of an inverted funnel such that it is wider at the bottom, with the open bottom of throat member 92 mating with the open top of basin member 91. The top of throat member 92 is closed to prevent rain entry, and one or more lateral openings 93 are disposed near the top of throat member 92. A bucket-like receptacle member 94 made of a non-flammable material is positioned within basin member 91. A cigarette butt is disposed by inserting it through one of lateral openings 93, whereupon it falls through throat member 92 and into receptacle member 94. Throat member 92 is periodically disconnected from basin member 91 and to enable convenient removal, emptying and replacement of receptacle member 94.

In accordance with the present invention, an odor absorption device 10 containing an odor absorptive material 11 is mounted within cigarette butt containment vessel 90. In its most basic sense, the present invention may be practiced by loosely placing or spreading a granularized odor absorptive material within basin member 91 or receptacle member 94, although this is the least preferred embodiment due to the increased difficulty in retrieving and replacing, by sifting or screening or otherwise, odor absorptive material 11. In accordance with the embodiment shown in FIG. 1, odor absorption device 10 includes an absorptive material housing 12 in which odor absorptive material 11 is retained and which may be simply placed into basin member 91 or receptacle member 94, but is more preferably secured in place at a location above receptacle member 94. Odor absorptive material 11 may comprise a variety of materials or combinations of materials that absorb cigarette smoke and odors produced by nicotine, tar or other substances emitted by cigarette butts. Examples of odor absorptive materials that may be deployed within odor absorption device 10 include activated carbon or charcoal, or combinations thereof.

People often misuse cigarette containment vessels, such as containment vessel 90 as trash receptacles for small paper article, food and cigarette wrappers, etc. thus creating a fire hazard within such containment vessels. Furthermore, the disposal of lit cigarette butts into cigarette containment vessels such as containment vessel 90 significantly contributes to and aggravates the problem of smoke and odor emanating therefrom. To address the fire problem and the problematic relation between containment vessel odors and the tendency of the collected butts to internally smolder, odor absorption device 10 is advantageously designed and deployed to serve as a fire or combustion retardant as well as an odor absorbing deodorizer. To this end, and in accordance with a preferred embodiment, the odor absorptive material 11 deployed within absorptive material housing 12 preferably comprises materials exhibiting fire retardant properties. Specifically, odor absorptive material includes a combustion reactive material such as sodium carbonate or sodium bi-carbonate which, responsive to exposure to combustion temperatures such as those that may be encountered near smoldering cigarette butts, releases a combustion suppressing gas (i.e. a gas that displaces oxygen sufficiently to act as a fire retardant). In alternate preferred embodiments, odor absorptive material 11 comprises sodium carbonate or sodium bi-carbonate, which when exposed to sufficiently high combustion temperatures release sufficient quantities of carbon dioxide in the substantially enclosed volume of containment vessel 90 such that smoldering or flames are suppressed.

Absorptive material housing 12 may be relatively rigid or flexible and is preferably inherently non-flammable or has been treated to make it non-flammable. The encasement material of absorptive material housing 12 preferably comprises an air-permeable fabric material that retains the granularized odor absorptive material 11 while permitting airflow between basin cavity 97 and the interior of absorptive material housing 12. In a preferred embodiment the encasement material of absorptive material housing 12 comprises a combustion resistant metal mesh, screen, or most preferably of a meshed, woven or apertured fabric. Furthermore, absorptive material housing 12 may be formed in a variety of shapes and may be quilted or otherwise partitioned to prevent shifting of odor absorptive material 11 within the housing 12.

In accordance with the embodiment depicted in FIG. 1, odor absorption device 10 has a generally rectangular contour with absorptive material housing 12 attached to the internal wall of cigarette butt containment vessel 90 at a location where odor absorption device 10 does not block the pathway of the cigarette butts falling into receptacle member 94. Any suitable attachment means 13, such as for example hook-and-loop-type fasteners, adhesive, mechanical interlocks, structured pockets, etc., may be utilized to secure odor absorption device 10 to an upper, inner surface wall of basin cavity 97 in a removable manner over receptacle member 94. It should be noted that the depicted deployment of the various embodiments of odor absorption devices, including odor absorption device 10, within cigarette butt containment vessel 90 having an overall containment structure of the type disclosed in U.S. Pat No. 6,186,355 is for illustrative purposes only and that alternative shapes of butt containment vessels may be employed without departing from the spirit or scope of the present invention.

Figure 2:
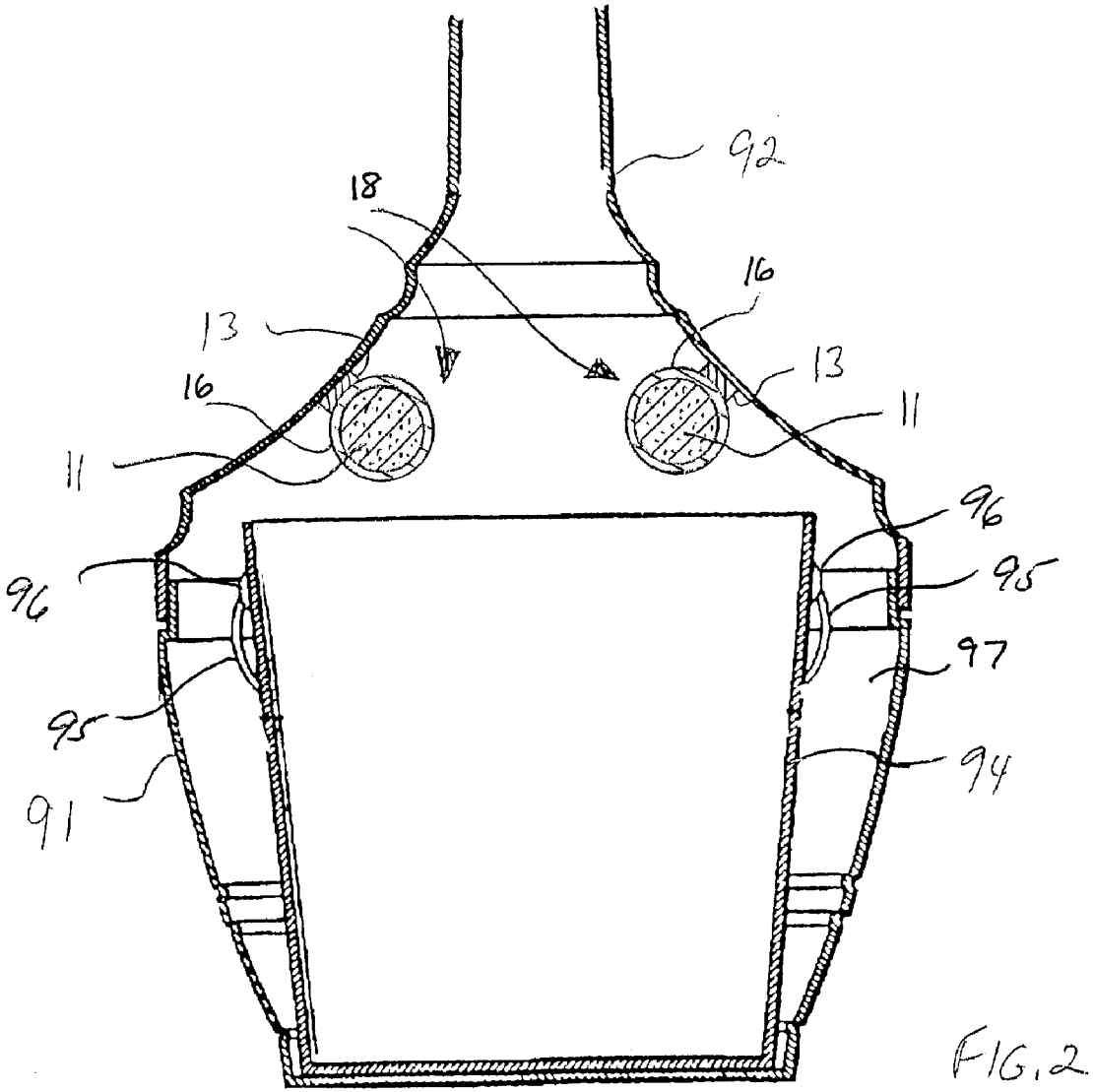
FIG. 2 is a partial cross-section view depicting an annular odor absorption device deployed over a receptacle bucket in accordance with an alternate embodiment.

Referring to FIG. 2, there is illustrated a partial cross-section view showing a more preferred embodiment in which an annular, doughnut-shaped odor absorption device 18 is disposed atop receptacle member 94. Odor absorption device 18 comprises an absorptive material housing 16 formed as a cylindrical ring and containing an annularly disposed absorptive material 11. In this configuration, odor absorption device 18 may be disposed directly on the top rim surface of receptacle member 94 or attached internally to the wider lower portion of throat member 92 using suitable attachment means 13. The depicted embodiment allows for a larger amount of absorptive material 11 to be utilized and advantageously deployed. The circular interior opening of cylindrical absorptive material housing 16 is maintained sufficiently large so as not to interfere with the path of the falling cigarette butts. Increasing the thickness of annular odor absorption device 18 so that the interior opening is closer in size to the reduced diameter of throat member 92 is also desirable as it will capture more smoke convecting within basin cavity 97.

Figure 3A:
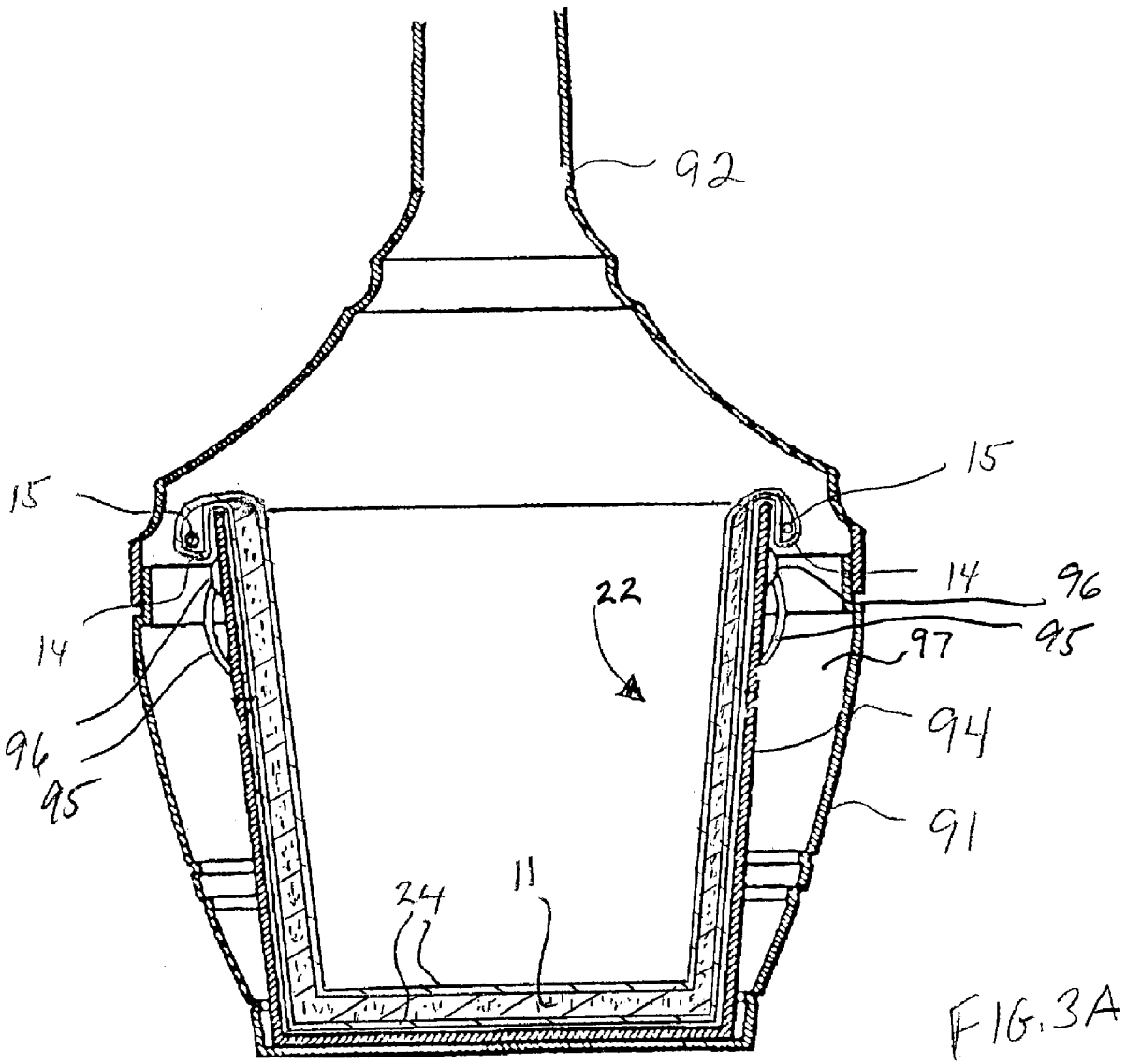
FIGS. 3A and 3B are a partial cross-section views illustrating liner-type odor absorption devices deployed within the receptacle bucket in accordance with alternate embodiments of the present invention.

With reference to FIG. 3, there is depicted an alternate preferred embodiment wherein a bag-like absorptive material housing is disposed within receptacle member 94. Specifically, FIG. 3 illustrates an alternate odor absorption device 22 having an absorptive material housing 24 constructed in the form of a bag or a bucket liner that is positioned within and in substantial conformity with the inner contour of receptacle member 94. A rim flap 14 of absorptive material housing 24 is sized so as to be able to be folded over the top rim of receptacle member 94. Most preferably, a closure fastening member 15 such as a drawstring, elastic band, or similar mechanism is provided so that the open top of the liner absorption device 22 can be secured against the receptacle member rim when disposed within containment vessel 90, and further enables liner absorption device 22 to be closed when removed from containment vessel 90. In this manner, removal of the cigarette butts is accomplished by lifting odor absorption device 22 from receptacle member 94 and utilizing closure member 15 to close the opening of the absorption device 22 to securely retain the butts. Odor absorption device 22 and butts may therefore be conveniently discarded as a unit and a new liner absorption device 22 is placed into receptacle member 94.

Figure 3B:
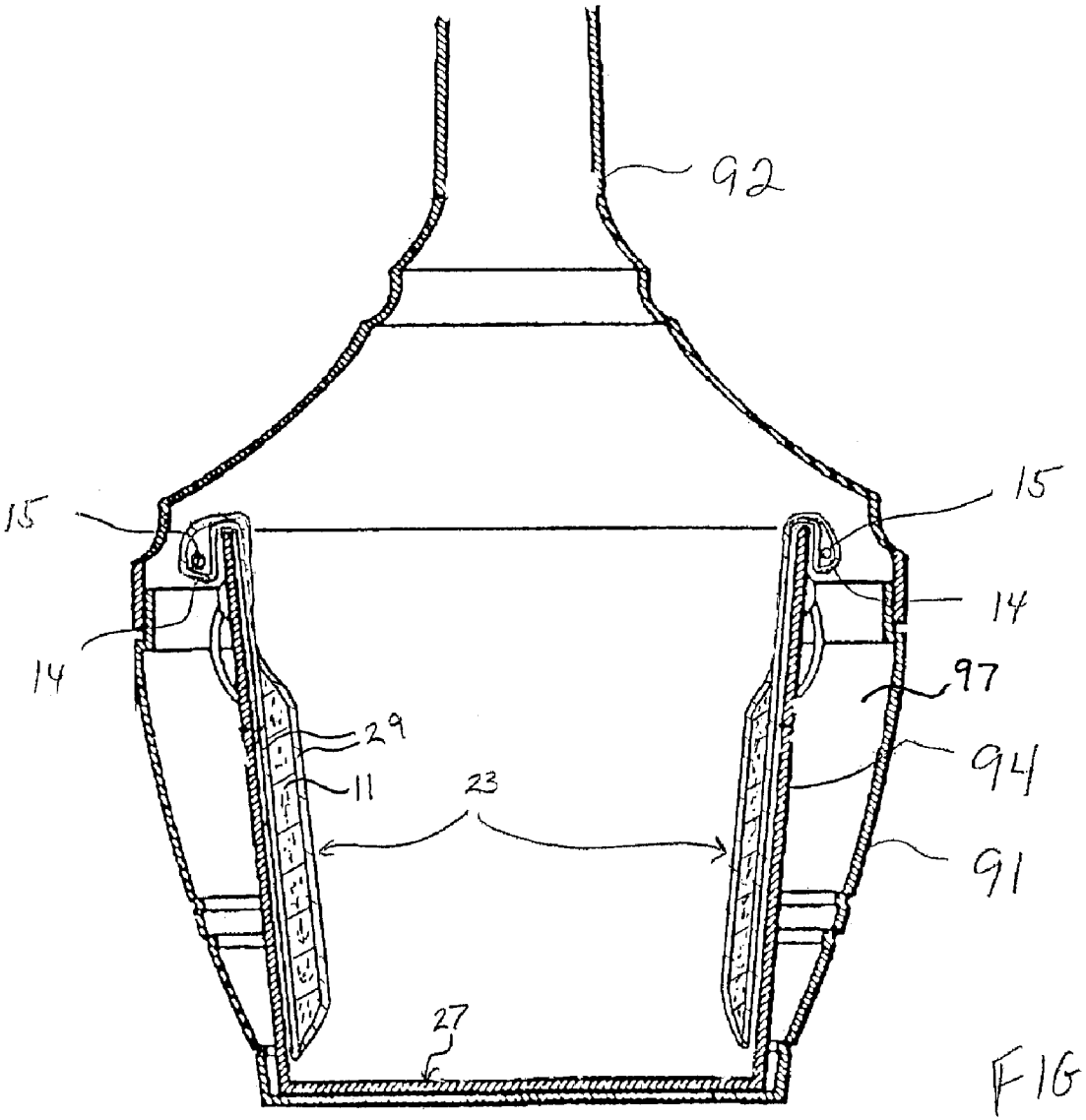

Referring to FIG. 3B, there is illustrated an alternative odor absorption device 23 wherein odor absorptive material 11 is retained in an absorptive material housing 29 constructed in the form of a bottomless receptacle liner lining the lateral inner wall surfaces of receptacle member 94 such that the cigarette butts collect on the floor 27 of receptacle member 94 rather than within odor absorption device 23. In this manner, odor absorption device 23 is less susceptible to damage or discoloration and need not be disposed of when the collected cigarette butts are emptied from receptacle member 94.

Figure 4A:
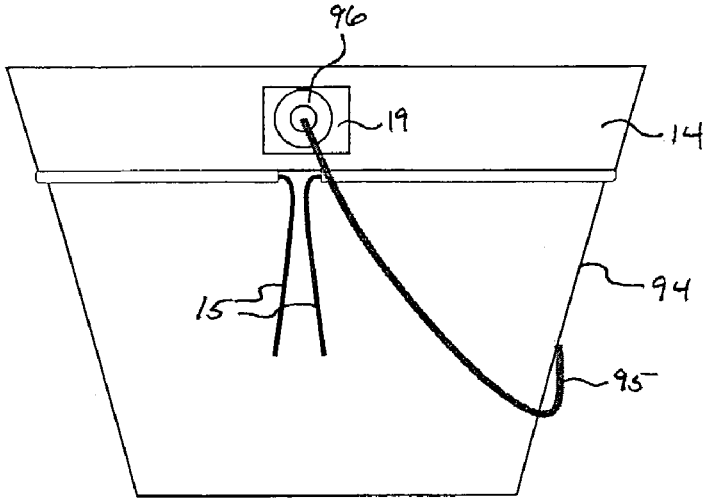
FIG. 4A is a side view depicting the liner-type odor absorption device mounted within the receptacle bucket using a drawstring type closure member in accordance with an alternate embodiment.
Figure 4B:
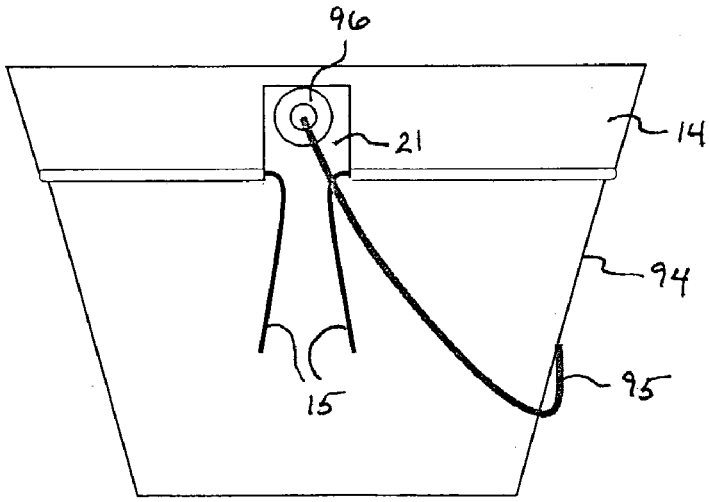
FIG. 4B is a side view illustrating the liner-type odor absorption device mounted within the receptacle bucket using a drawstring type closure member in accordance with an alternate embodiment.

FIGS. 4A and 4B depict alternate embodiments of the liner type odor absorption device. As shown in FIG. 4A, rim flap 14 is folded over the open rim of receptacle member 94 where it coincides with a bucket handle hinge 96 that hinges a receptacle carrying handle 95 to receptacle member 94. In accordance with the embodiment illustrated in FIG. 4A, a bounded aperture 19 is disposed within rim flap 14 to enable handle hinge 96 to extend therethrough, thus facilitating a secure fastening of rim flap 14 to receptacle member 94. Although not illustrated, an identical handle hinge for supporting receptacle carrying handle 95 will be disposed on the diametrically opposed outer sidewall of receptacle member 94 and will be accommodated by a corresponding bounded aperture. However, receptacle handle 95 presents an obstacle to sliding rim flap 14 over the open rim, requiring receptacle handle 95 and/or handle hinge 96 to be temporarily removed in order to install rim flap 14 on the outer rim of receptacle member 94. The embodiment depicted in FIG. 4B eliminates this problem by constructing rim flap 14 to have an open slot aperture 21 that enables rim flap 14 to be folded over the rim of receptacle member 94 and around handle 95 and handle hinge 96 such that the liner type odor absorption device can be installed without having to remove handle 95 and/or handle hinge 96. As shown in FIG. 4B, when closure means 15 are mutually fastened, open slot aperture 21 is bounded only by closure means 15 on its lower edge.

While this invention has been described in terms of several embodiments, it is contemplated that alterations, permutations, and equivalents thereof will become apparent to one of ordinary skill in the art upon reading this specification in view of the drawings supplied herewith. It is therefore intended that the invention and any claims related thereto include all such alterations, permutations, and equivalents that are encompassed by the spirit and scope of this invention.

What is claimed is:

1. An apparatus for suppressing odor emanating from a cigarette butt containment vessel, wherein said cigarette butt containment vessel includes a partially enclosed basin cavity and a throat member into which cigarette butts are deposited and pass therethrough into the basin cavity, said basin cavity containing a removable receptacle member into which cigarette butts are collected, said apparatus comprising an odor absorption device mounted within the cigarette butt containment vessel, wherein said odor absorption device comprises an absorptive material housing containing an odor absorptive material and further comprising attachment means for detachably securing said absorptive material housing to an inner surface of the containment vessel, and wherein said absorptive material housing is a cylindrical ring encircling the perimeter profile formed by said throat member.

2. The apparatus of claim 1, wherein said absorptive material housing comprises an air-permeable, combustion resistant fabric or mesh material that retains the odor absorptive material while permitting airflow between the basin cavity and the interior of the absorptive material housing.

3. The apparatus of claim 2, wherein said odor absorptive material comprises a granularized odor absorbing material.

4. The apparatus of claim 1, wherein said odor absorptive material exhibits fire retardant properties.

5. The apparatus of claim 4, wherein responsive to exposure to combustion temperatures said odor absorptive material releases a combustion suppressing gas.

6. The apparatus of claim 5, wherein said odor absorptive material includes sodium carbonate.

7. The apparatus of claim 5, wherein said odor absorptive material includes sodium bi-carbonate.

8. The apparatus of claim 5, wherein the combustion suppressing gas includes carbon dioxide gas.

9. An apparatus for suppressing odor emanating from a cigarette butt containment vessel, wherein said cigarette butt containment vessel includes a partially enclosed basin cavity containing a removable receptacle member into which cigarette butts are collected, said apparatus comprising an odor absorption device positioned within the cigarette butt containment vessel, wherein said odor absorption device comprises an absorptive material housing containing an odor absorptive material and wherein said absorptive material housing is disposed as a liner lining the interior of said receptacle member, the absorptive material housing liner having an enclosed cavity in which the odor absorptive material is distributed in substantial conformity with the inner lateral contour of said receptacle member, and wherein said absorptive material housing liner is a bottomless liner lining only the inner lateral contour of said receptacle member, wherein said odor absorption device further includes closure means for securing the absorptive material housing liner to an open rim of said receptacle member, wherein said receptacle member is a fire resistant bucket that includes at least one handle hinge extending from the external sidewall thereof, said absorptive material housing including a rim flap folded over an open rim of the fire resistant bucket, and wherein said closure means is disposed within the rim flap, said rim flap including a bounded aperture through which the at least one handle hinge extends when the odor absorption device is installed on said fire resistant bucket.

10. The apparatus of claim 9, wherein said closure means is a drawstring.

11. The apparatus of claim 9, wherein said closure means is an elastic band.

12. The apparatus of claim 9, wherein said odor absorptive material exhibits fire retardant properties.

13. The apparatus of claim 12, wherein responsive to exposure to combustion temperatures said odor absorptive material releases a combustion suppressing gas.

14. The apparatus of claim 13, wherein said odor absorptive material includes sodium carbonate.

15. The apparatus of claim 13, wherein said odor absorptive material includes sodium bi-carbonate.

16. The apparatus of claim 13, wherein the combustion suppressing gas includes carbon dioxide gas.

17. The apparatus of claim 9, wherein said absorptive material housing comprises an air-permeable, combustion resistant fabric or mesh material that retains the odor absorptive material while permitting airflow between the basin cavity and the interior of the absorptive material housing.

18. The apparatus of claim 17, wherein said odor absorptive material comprises a granularized odor absorbing material.

19. An apparatus for suppressing odor emanating from a cigarette butt containment vessel, wherein said cigarette butt containment vessel includes a partially enclosed basin cavity containing a removable receptacle member into which cigarette butts are collected, said apparatus comprising an odor absorption device positioned within the cigarette butt containment vessel, wherein said odor absorption device comprises an absorptive material housing containing an odor absorptive material and wherein said absorptive material housing is disposed as a liner lining the interior of said receptacle member, the absorptive material housing liner having an enclosed cavity in which the odor absorptive material is distributed in substantial conformity with the inner lateral contour of said receptacle member, and wherein said absorptive material housing liner is a bottomless liner lining only the inner lateral contour of said receptacle member, wherein said odor absorption device further includes closure means for securing the absorptive material housing liner to an open rim of said receptacle member, wherein said receptacle member is a fire resistant bucket that includes at least one handle hinge extending from the external sidewall thereof, said absorptive material housing including a rim flap folded over an open rim of the fire resistant bucket, and wherein said closure means is disposed within the rim flap, said rim flap including an open slot aperture through which the at least one handle hinge extends when the odor absorption device is installed on said fire resistant bucket such that said open slot aperture is bounded on one side only by said closure means.

20. The apparatus of claim 19, wherein said closure means is a drawstring.

21. The apparatus of claim 19, wherein said closure means is an elastic band.

22. The apparatus of claim 19, wherein said odor absorptive material exhibits fire retardant properties.

23. The apparatus of claim 22, wherein responsive to exposure to combustion temperatures said odor absorptive material releases a combustion suppressing gas.

24. The apparatus of claim 23, wherein said odor absorptive material includes sodium carbonate.

25. The apparatus of claim 23, wherein said odor absorptive material includes sodium bi-carbonate.

26. The apparatus of claim 23, wherein the combustion suppressing gas includes carbon dioxide gas.

27. The apparatus of claim 19, wherein said absorptive material housing comprises an air-permeable, combustion resistant fabric or mesh material that retains the odor absorptive material while permitting airflow between the basin cavity and the interior of the absorptive material housing.

28. The apparatus of claim 27, wherein said odor absorptive material comprises a granularized odor absorbing material.

29. An odor suppressed cigarette butt containment vessel comprising:

an elongated, tubular throat member communicatively coupled to a basin member, wherein said throat member includes one or more lateral openings for depositing cigarette butts that pass therethrough and into the basin member;

a removable receptacle member disposed within said basin member and beneath said throat member; and an odor absorption device detachably positioned within the containment vessel, wherein said odor absorption device includes an absorptive material housing containing an odor absorptive material, and wherein said absorptive material housing is a cylindrical ring containing an annularly disposed odor absorptive material.

30. The odor suppressed cigarette butt containment vessel of claim 29, wherein said absorptive material housing comprises an air-permeable, combustion resistant mesh or fabric material that retains the odor absorptive material while permitting airflow between the basin member and the interior of the absorptive material housing.

31. The odor suppressed cigarette butt containment vessel of claim 29, further comprising attachment means for detachably securing said absorptive material housing to an inner surface of the containment vessel.

32. The odor suppressed cigarette butt containment vessel of claim 29, wherein said odor absorptive material comprises a granularized odor absorbing material.

33. The odor suppressed cigarette butt containment vessel of claim 29, wherein said odor absorptive material exhibits fire retardant properties.

34. The odor suppressed cigarette butt containment vessel of claim 33, wherein responsive to exposure to combustion temperatures said odor absorptive material releases a combustion suppressing gas.

35. The odor suppressed cigarette butt containment vessel of claim 34, wherein said odor absorptive material includes sodium carbonate.

36. The odor suppressed cigarette butt containment vessel of claim 34, wherein said odor absorptive material includes sodium bi-carbonate.

37. The odor suppressed cigarette butt containment vessel of claim 34, wherein the combustion suppressing gas includes carbon dioxide gas.

38. The odor suppressed cigarette butt containment vessel of claim 29, wherein said absorptive material housing is disposed on top of said receptacle member.

39. The odor suppressed cigarette butt containment vessel of claim 29, wherein said absorptive material housing is attached to said throat member.

* * * * *